US010113219B2

(12) United States Patent
Zhang et al.

(10) Patent No.: US 10,113,219 B2
(45) Date of Patent: Oct. 30, 2018

(54) NANO-PEARLITE RAIL AND PROCESS FOR MANUFACTURING SAME

(71) Applicant: Yanshan University, Hebei (CN)

(72) Inventors: Fucheng Zhang, Hebei (CN); Bo Lv, Hebei (CN); Shuo Liu, Hebei (CN); Zhinan Yang, Hebei (CN); Mingming Wang, Hebei (CN); Yangzeng Zheng, Hebei (CN)

(73) Assignee: Yanshan University, Qinhuangdao, Hebei (CN)

( * ) Notice: Subject to any disclaimer, the term of this patent is extended or adjusted under 35 U.S.C. 154(b) by 602 days.

(21) Appl. No.: 14/665,427

(22) Filed: Mar. 23, 2015

(65) Prior Publication Data

US 2015/0368765 A1 Dec. 24, 2015

(30) Foreign Application Priority Data

Jun. 24, 2014 (CN) ..... 2014 1 0285670

(51) Int. Cl.

| | |
|---|---|
| ***C22C 38/30*** | (2006.01) |
| ***C22C 38/28*** | (2006.01) |
| ***C22C 38/20*** | (2006.01) |
| ***C22C 38/02*** | (2006.01) |
| ***C22C 38/04*** | (2006.01) |
| ***C22C 38/06*** | (2006.01) |
| ***C21D 9/04*** | (2006.01) |
| ***C21D 1/30*** | (2006.01) |

(52) U.S. Cl.

CPC ..... *C22C 38/30* (2013.01); *C21D 1/30* (2013.01); *C21D 9/04* (2013.01); *C22C 38/02* (2013.01); *C22C 38/04* (2013.01); *C22C 38/06* (2013.01); *C22C 38/20* (2013.01); *C22C 38/28* (2013.01); *C21D 2201/03* (2013.01); *C21D 2211/009* (2013.01)

(58) Field of Classification Search

CPC ..... C22C 38/02; C22C 38/04; C22C 38/06; C22C 38/20; C22C 38/28; C22C 38/30; C21D 1/30; C21D 9/04; C21D 2211/009; C21D 2201/03

See application file for complete search history.

(56) References Cited

U.S. PATENT DOCUMENTS

| | | | | |
|---|---|---|---|---|
| 4,735,771 | A * | 4/1988 | Corwin | C22C 38/00 420/129 |
| 4,767,475 | A | 8/1988 | Fukuda et al. | |
| 5,658,400 | A | 8/1997 | Uchino et al. | |
| 5,676,772 | A | 10/1997 | Kobayashi et al. | |
| 7,972,451 | B2 | 7/2011 | Ueda et al. | |
| RE42,668 | E | 9/2011 | Ueda et al. | |
| 8,361,246 | B2 | 1/2013 | Ueda et al. | |
| 2003/0192625 | A1 | 10/2003 | Cordova | |
| 2004/0035507 | A1 | 2/2004 | Cordova | |
| 2010/0102910 | A1* | 4/2010 | Waeckerle | C21D 1/74 335/297 |
| 2011/0284139 | A1* | 11/2011 | Nishida | C21D 8/065 148/598 |
| 2014/0102603 | A1 | 4/2014 | Han et al. | |
| 2014/0187981 | A1 | 7/2014 | Millett et al. | |

FOREIGN PATENT DOCUMENTS

| | | | | |
|---|---|---|---|---|
| CN | 1155013 | A | 7/1997 | |
| CN | 1044723 | C | 8/1999 | |
| CN | 1107735 | C | 5/2003 | |
| CN | 1884606 | A | 12/2006 | |
| CN | 101818312 | A | 9/2010 | |
| CN | 102936700 | A | 2/2013 | |
| CN | 103160736 | A | 6/2013 | |
| EP | 2055797 | A1 * | 8/2007 | C22C 38/00 |
| JP | H07126741 | A | 5/1995 | |
| JP | 2002-363696 | A | 12/2002 | |
| JP | 2005-256022 | A | 9/2005 | |

OTHER PUBLICATIONS

Buono et al., "Measurement of fine pearlite interlamellar spacing by atomic force microscopy," J. Materials Science, 32 (1997), pp. 1005-1008.*

* cited by examiner

*Primary Examiner* — Keith Walker
*Assistant Examiner* — John A Hevey
(74) *Attorney, Agent, or Firm* — McDonnell Boehnen Hulbert & Berghoff LLP

(57) ABSTRACT

A nano-pearlite rail and a process for manufacturing the same wherein the rail has excellent mechanical properties, including a tensile strength of no less than 1300 MPa, a yield strength of no less than 1000 MPa, a hardness of HRC 44-47, and an elongation of no less than 10%, as well as excellent wear resistance and fatigue resistance, and is particularly suitable for applications in heavy-haul railways, especially for the railway segments having a sharp turn, and for a wing rail in a bainite steel combined frog.

1 Claim, No Drawings

NANO-PEARLITE RAIL AND PROCESS FOR MANUFACTURING SAME

CROSS-REFERENCE TO RELATED APPLICATION

The present application claims priority under 35 U.S.C. 119 from Chinese patent application No. 201410285670.2, which was filed on Jun. 24, 2014 with the title of "Process for Manufacturing Nano-Pearlite Rail", the content of which is incorporated herein in its entirety by reference.

FIELD OF TILE INVENTION

The invention belongs to the technical field of steel and iron materials and thermal processing thereof, and particularly relates to a steel rail and a process for manufacturing the same.

BACKGROUND OF THE INVENTION

Since early twenty-first century, railway transportation has seen a global revival. Among all the modes of transportation, railway is the most environment-friendly and energy efficient mode of transportation on the land. At present, in order to sufficiently release the potential of railway transportation, railway transportation is being developed toward a direction of high speed and heavy load. Steel rail is an important part of the track structure, and the quality of the steel rail is directly related to the safety and efficiency of railway operations. In order to meet the requirements of the construction and development of the railway, especially heavy-haul railway, there is an urgent need to improve the strength, wear resistance and fatigue resistance of the steel for railway. Generally, the steel for a traditional steel rail, for example, with China code of U75Mn, has a carbon content of 0.6-0.8 wt %, and belongs to eutectoid steels, which has a tensile strength of ≥880 MPa and a hardness ranging from 260 to 300 HB. In order to improve the strength and wear resistance, elements such as Nb, V, rare earth, and so on are added to original composition of the pearlitic rail, and the processes such as controlled rolling are used to improve the mechanical properties thereof, as described in Chinese Patents CN 10447230 and CN 11077350, U.S. Pat. Nos. 5,658,400 and 4,767,475, etc., which disclose rails corresponding to China codes of U75V, U76NbRe, U77MnCr, etc. The microstructures of these types of rails are all pearlite structures. Among them, the most widely used rails are U75Mn and U75V rails. Comparing with U71Mn rail, U75V rail has a higher carbon content, and further comprises silicon and vanadium elements. Accordingly, U75V rail has an improved strength and significantly superior wear resistance, but a poorer plasticity and toughness than U71Mn rail. Meanwhile, U71Mn rail has superior resistance fatigue crack growth, fracture toughness and weldability performances over U75V rail.

In order to further improve the service life of the rail, researchers have conducted numerous studies and explorations in recent years on the design of the alloy composition of the rail, and have invented and developed many novel ultra-fine pearlite rail with high overall properties by adding elements such as Cr, Mo, V, Ti, Nb, Co, Cu, Ni, B, N, Al, Zr, etc. to ordinary rails having eutectoid carbon contents, and adopting new rolling processes and heat treatment techniques, such as those described in U.S. Pat. RE42,668, U.S. Pat. Nos. 7,972,451 and 8,361,246, United States Patent Applications US 2004035507-A1 and US 2003192625-A1; Chinese Patent Applications CN 101818312A, CN 1884606A, and CN 1522311A; Japanese Patent Application Nos. JP 2005256022-A, JP 2002363696-A and JP 7126741-A; etc. These patented technologies improved the strength and wear resistance and fatigue resistance of the rail to different degrees. Some specific thermal treatments were also performed after rolling to improve the strength and wear resistance of the rail, such as those described in Chinese Patent CN1155013, etc. Furthermore, a bainite rail is manufactured by introducing a bainite microstructure into the rail to improve its obdurability, such as those described in Chinese Patent Applications CN102899471A, CN103160736A, and CN102936700A; U.S. Pat. No. 5,676,772; etc. The microstructures of these rails are in a macro- or micro-scale, but not a nano-scale, and then the performance potential of these rails were not thoroughly released.

It has been showed that a pearlitic structure has excellent overall mechanical properties when it is refined to a nanoscale (see Scripta Materialia, 2012, 67(1): 53-56). Accordingly, it is believed that a nano-pearlite rail would have a high strength, as well as an excellent wear resistance and fatigue resistance. However, the average interlamellar spacing of pearlite in conventional pearlite rails is in a submicron or even micron scale, while that in the so-called ultra-fine pearlite rail is also more than 150 nm. It is very difficult to reach a nanoscale (>100 nm) in a manufacturing process.

Several inventions relating to pearlite rails addressed the ultra-fine pearlite. For example, Chinese Patent Application CN1884606A discloses a pearlite structure manufactured mainly by a heat deformation process, which has an insufficient hardness, tensile strength, and elongation. Chinese Patent Applications CN1522311A and CN1140473A filed by Japanese applicants describe rails having carbon contents up to 1.2 wt. % and 1.4 wt %, respectively, and high contents of Mn, but being free of Al. It is impossible for these rails to have a nanoscale microstructure. In order to obtain a rail having a fine pearlite structure, it is required by the technology patented by the Japanese to rapidly cool the rail immediately after rolling to avoid growth of the pearlite structure. This increases the complexity of the process for manufacturing rails, and makes it impractical.

SUMMARY OF THE INVENTION

An object of the present invention is to provide a process for manufacturing a nano-pearlite rail having high strength, hardness, plasticity, wear resistance and fatigue resistance, which is simple, and easy to be operated in large scales.

The nano-pearlite rail according to the present invention is a steel rail having an internal microstructure of 100% pearlite with an average interlamellar spacing of pearlite of 55-70 nm, and containing 0.83 to 0.93 of C, 0.05 to 0.10 of Mn, a certain content of Al and Si, 1.0 to 1.5 of Cr, 0.1 to 0.3 of Co, 0.35 to 0.55 of Zr, 0.02 to 0.06 of Mg, 0.01 to 0.05 of Cu, less than 0.025 of S, less than 0.025 of P, and reminder of Fe, wherein the content of Al is 8 to 12 times the content of Mn and the collective content of Al and Si is 1.5 (in wt. %).

A process for manufacturing the above nano-pearlite rail comprises:

(1) smelting a molten steel having the above chemical composition using a basic oxygen furnace or an electric-arc furnace, followed by external refining and vacuum degassing treatment, and continuous casting and rolling to form a rail;

(2) using the following parameters: an initial rolling temperature of no higher than 1150° C., a rolling deformation rate of 5-8 $s^{-1}$, a single-pass deformation of 30-50%, a total compression ratio of more than 10, and a finishing rolling temperature of no lower than 950° C.;

(3) air cooling after rolling to a railhead temperature of 850° C. and maintaining the temperature for 20-30 min, cooling at a cooling rate of 30-50° C./min to a railhead temperature of no higher than 550° C. and maintaining the temperature for 30-40 min, air cooling to a temperature of 350° C. and maintaining the temperature for 60-90 min, and finally air cooling to room temperature; and (4) reheating to 250-300° C. and maintaining the temperature for 60-90 min for stress relieving and tempering treatment.

Preferably, the continuous casting and rolling may be carried out in a protective atmosphere. In one embodiment, the protective atmosphere may be a vacuum atmosphere. In another embodiment, the protective atmosphere may be an argon atmosphere.

Comparing with the prior art, the present invention achieves the following advantages:

1. the manufacture process is simple, and easy to be operated in a large scale; and 2. the rail thus obtained has very excellent mechanical properties, including a tensile strength of no less than 1300 MPa, a yield strength of no less than 1000 MPa, a hardness of HRC 44-47, and an elongation of no less than 10%, as well as excellent wear resistance and fatigue resistance; and is particularly suitable for applications in heavy-haul railways, especially for the railway segments having a sharp turn, and for a wing rail in bainite steel combined frog.

DETAILED DESCRIPTION OF THE INVENTION AND PREFERRED EMBODIMENTS

Examples

Example 1

A molten steel containing 0.83 of C, 0.05 of Mn, 0.6 of Al, 0.9 of Si, 1.4 of Cr, 0.11 of Co, 0.35 of Zr, 0.06 of Mg, 0.05 of Cu, 0.013 of S, 0.005 of P, and reminder of Fe (in wt. %), is smelted using a basic oxygen furnace, followed by external refining and vacuum degassing treatment, and continuous casting and rolling in a vacuum atmosphere to form a steel rail. In the rolling process, the following parameters are used: an initial rolling temperature of 1140° C., a rolling deformation rate of 6 $s^{-1}$, a single-pass deformation of 32%, a total compression ratio of 12, and a finishing rolling temperature of 960° C. After rolling, the rail is air cooled to a railhead temperature of 850° C. and the temperature is maintained for 30 min, followed by cooling at a cooling rate of 30° C./min to a railhead temperature of no higher than 550° C. and maintaining the temperature for 40 min, and air cooling to a temperature of 350° C. and maintaining the temperature for 80 min, and finally air cooling to room temperature. The cooled rail is then reheated to a temperature of 250° C. and the temperature is maintained for 60 min for stress relieving and tempering treatment. The rail thus obtained has an internal microstructure of 100% pearlite with an average interlamellar spacing of pearlite of 60 nm, which is nano-pearlitic. Therefore, the rail has very excellent mechanical properties, including a tensile strength of 1350 MPa, a yield strength of 1010 MPa, a hardness of HRC 44 and an elongation of 11%, as well as excellent wear resistance and fatigue resistance.

Example 2

A molten steel containing 0.92 of C, 0.09 of Mn, 1.0 of Al, 0.5 of Si, 1.1 of Cr, 0.18 of Co, 0.52 of Zr, 0.04 of Mg, 0.03 of Cu, 0.001 of S, 0.011 of P, and reminder of Fe (in wt. %), is smelted using a basic oxygen furnace, followed by external refining and vacuum degassing treatment, and continuous casting and rolling in an argon atmosphere to form a steel rail. In the rolling process, the following parameters are used: an initial rolling temperature of 1120° C., a rolling deformation rate of 8 $s^{-1}$, a single-pass deformation of 48%, a total compression ratio of 11, and a finishing rolling temperature of 950° C. After rolling, the rail is air cooled to a railhead temperature of 850° C. and the temperature is maintained for 20 min, followed by cooling at a cooling rate of 50° C./min to a railhead temperature of no higher than 550° C. and maintaining the temperature for 30 min, and air cooling to a temperature of 350° C. and maintaining the temperature for 60 min, and finally air cooling to room temperature. The cooled rail is then reheated to a temperature of 300° C. and the temperature is maintained for 90 min for stress relieving and tempering treatment. The rail thus obtained has an internal microstructure of 100% pearlite with an average interlamellar spacing of pearlite of 55 nm, which is nano-pearlitic, Therefore, the rail has very excellent mechanical properties, including a tensile strength of 1370 MPa, a yield strength of 1050 MPa, a hardness of HRC 45 and an elongation of 12%, as well as excellent wear resistance and fatigue resistance.

Example 3

A molten steel containing 0.85 of C, 0.07 of Mn, 0.7 of Al, 0.8 of Si, 1.3 of Cr, 0.11 of Co, 0.35 of Zr, 0.06 of Mg, 0.05 of Cu, 0.010 of S, 0.005 of P, and reminder of Fe wt. %), is smelled using a basic oxygen furnace, followed by external refining and vacuum degassing treatment, and continuous casting and rolling in a vacuum atmosphere to form a steel rail. In the rolling process, the following parameters are used: an initial rolling temperature of 1100° C., a rolling deformation rate of 8 $s^{-1}$, a single-pass deformation of 42%, a total compression ratio of 11, and a finishing rolling temperature of 960° C. After rolling, the rail is air cooled to a railhead temperature of 850° C. and the temperature is maintained for 25 min, followed by cooling at a cooling rate of 35° C./min to a railhead temperature of no higher than 550° C. and maintaining the temperature for 35 min, and air cooling to a temperature of 350° C. and maintaining the temperature for 70 min, and finally air cooling to room temperature. The cooled rail is then reheated to a temperature of 280° C. and the temperature is maintained for 70 min for stress relieving and tempering treatment. The rail thus obtained has an internal microstructure of 100% pearlite with an average interlamellar spacing of pearlite of 65 nm, which is nano-pearlitic. Therefore, the rail has very excellent mechanical properties, including a tensile strength of 1360 MPa, a yield strength of 1030 MPa, a hardness of HRC 45 and an elongation of 12%, as well as excellent wear resistance and fatigue resistance.

Example 4

A molten steel containing 0.91 of C, 0.09 of Mn, 1.0 of Al, 0.5 of Si, 1.2 of Cr, 0.21 of Co, 0.44 of Zr, 0.05 of Mg, 0.02 of Cu, 0.008 of S, 0.016 of P, and reminder of Fe (in wt. %), is smelted using a basic oxygen furnace, followed by external refining and vacuum degassing treatment, and continuous casting and rolling in an argon atmosphere to form a steel rail. In the rolling process, the following parameters are used: an initial rolling temperature of 1100° C., a rolling deformation rate of 8 $s^{-1}$, a single-pass deformation of 35%, a total compression ratio of 12, and a finishing rolling temperature of 960° C. After rolling, the rail is air cooled to a railhead temperature of 850° C. and the temperature is maintained for 25 min, followed by cooling at a cooling rate of 40° C./min to a railhead temperature of no higher than 550° C. and maintaining the temperature for 35 min, and air cooling to a temperature of 350° C. and maintaining the temperature for 90 min, and finally air cooling to room temperature. The cooled rail is then reheated to a temperature of 290° C. and the temperature is maintained for 65 min for stress relieving and tempering treatment. The rail thus obtained has an internal microstructure of 100% pearlite with an average interlamellar spacing of pearlite of 68 nm, which is nano-pearlitic. Therefore, the rail has very excellent mechanical properties, including a tensile strength of 1410 MPa, a yield strength of 1090 MPa, a hardness of HRC 47 and an elongation of 12%, as well as excellent wear resistance and fatigue resistance.

Example 5

A molten steel containing 0.90 of C, 0.06 of Mn, 0.7 of Al, 0.8 of Si, 1.1 of Cr, 0.28 of Co, 0.41 of Zr, 0.05 of Mg, 0.04 of Cu, 0.008 of S, 0.015 of P, and reminder of Fe (in wt. %), is smelted using a basic oxygen furnace, followed by external refining and vacuum degassing treatment, and continuous casting and rolling in an argon atmosphere to form a steel rail. In the rolling process, the following parameters are used: an initial rolling temperature of 1100° C., a rolling deformation rate of 7 $s^{-1}$, a single-pass deformation of 45%, a total compression ratio of 12, and a finishing rolling temperature of 955° C. After rolling, the rail is air cooled to a railhead temperature of 850° C. and the temperature is maintained for 27 min, followed by cooling at a cooling rate of 45° C./min to a railhead temperature of no higher than 550° C. and maintaining the temperature for 35 min, and air cooling to a temperature of 350° C. and maintaining the temperature for 75 min, and finally air cooling to room temperature. The cooled rail is then reheated to a temperature of 250° C. and the temperature is maintained for 85 min for stress relieving and tempering treatment. The rail thus obtained has an internal microstructure of 100% pearlite with an average interlamellar spacing of pearlite of 70 nm, which is nano-pearlitic, Therefore, the rail has very excellent mechanical properties, including a tensile strength of 1420 MPa, a yield strength of 1100 MPa, a hardness of HRC 47 and an elongation of 12%, as well as excellent wear resistance and fatigue resistance.

What is claimed is:

1. A nano-pearlite rail, which is a steel rail having an internal microstructure of 100% pearlite with an average interlamellar spacing of pearlite of 55-70 nm, and containing 0.83 to 0.93 of C, 0.05 to 0.10 of Mn, a certain content of Al and Si, 1.0 to 1.5 of Cr, 0.1 to 0.3 of Co, 0.35 to 0.55 of Zr, 0.02 to 0.06 of Mg, 0.01 to 0.05 of Cu, less than 0.025 of S, less than 0.025 of P, and reminder of Fe, wherein the content of Al is 8 to 12 times the content of Mn and the collective content of Al and Si is 1, wherein all the amounts are expressed in wt. %.

* * * * *